US007285757B2

(12) United States Patent
Muńoz et al.

(10) Patent No.: US 7,285,757 B2
(45) **Date of Patent: *Oct. 23, 2007**

(54) BOTTOM ELECTRIC HEATING ELEMENT SYSTEMS AND OVENS

(75) Inventors: Antonio Muńoz, City of Industry, CA (US); Jesus Rios, Jr., City of Industry, CA (US); Joey J. Kitabayashi, City of Industry, CA (US)

(73) Assignee: Distinctive Appliances, Inc., City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/220,893

(22) Filed: Sep. 6, 2005

(65) Prior Publication Data

US 2006/0016796 A1 Jan. 26, 2006

Related U.S. Application Data

(63) Continuation of application No. 10/817,258, filed on Apr. 1, 2004, now Pat. No. 6,949,720.

(51) Int. Cl.
*F27D 11/00* (2006.01)
*H05B 3/68* (2006.01)

(52) U.S. Cl. ..... 219/402; 219/443.1

(58) Field of Classification Search ..... 219/443.1, 219/444.1, 451.1, 452.11, 460.1, 402, 409, 219/411, 390, 391, 395
See application file for complete search history.

(56) References Cited

U.S. PATENT DOCUMENTS

| | | | | |
|---|---|---|---|---|
| 4,237,368 | A * | 12/1980 | Welch | 219/448.17 |
| 4,453,533 | A * | 6/1984 | Scheidler et al. | 126/211 |
| 5,399,839 | A * | 3/1995 | Taplan et al. | 219/452.12 |
| 6,533,289 | B2 * | 3/2003 | Bono et al. | 277/630 |
| 6,635,853 | B2 * | 10/2003 | Saito et al. | 219/465.1 |
| 6,949,720 | B1 * | 9/2005 | Munoz et al. | 219/402 |

* cited by examiner

*Primary Examiner*—Sang Paik

(57) ABSTRACT

A bottom electric heating element for an oven wherein the electric heating element is positioned in a recessed portion in the oven bottom and comprises at least one corrugated ribbon of conductive material partially embedded in an insulating base. A glass panel is positioned over the recessed portion and on a compressible heat resistant gasket. The glass panel is transparent or semi-transparent, high temperature resistant and high impact resistant. A frame extends around the glass panel and fastens it to the oven bottom while partially and resiliently compressing the gasket to support the glass panel.

4 Claims, 3 Drawing Sheets

BOTTOM ELECTRIC HEATING ELEMENT SYSTEMS AND OVENS

RELATED APPLICATION

This is a continuation of U.S. patent application Ser. No. 10/817,258, filed Apr. 1, 2004 now U.S. Pat. No. 6,949,720, the disclosure of which is incorporated herein by reference.

BACKGROUND OF THE INVENTION

The present invention relates to ovens with electric heating elements and to electric heating element systems.

Electric cooking ovens for residential use normally have an electric heating element along the bottom wall of the oven and an electric heating element along the top wall or ceiling of the oven, although a recent innovation has employed a gas broiler for the top heating element in an electric oven, as shown in U.S. Pat. No. 5,909,533. Electric cooking ovens are desirable for many reasons, such as the ability to be self-cleaning by developing an extremely high temperature. Conventionally the electric heating element for the bottom of a residential oven has been a Calrod which is supported by a wire frame a short distance above the bottom surface of the oven. The Calrod is an electric resistance heater rod and, when activated, begins to glow and produce heat and some infrared light waves. The Calrod heating element may be open to the oven or in some oven constructions is placed below a steel sheet coated with porcelain enamel that provides a bottom surface of the oven that may be wiped clean without removing the calrod heating element. In older ovens the Calrod element can be removed for cleaning the bottom of the ovens where the Calrod heating element is exposed. However, the porcelain enamel coating often cracks under the high temperatures to which it is subjected, such as by the self-cleaning cycle.

Recently, a ribbon-type heating element has been used as both the top and bottom heating elements in residential ovens because of the more rapid increase in temperature and higher temperature that may be achieved by such a ribbon-type element but the ribbon is susceptible to damage so it must be covered. While a high temperature glass has been used to cover and protect the ribbon-type heating element when used as the upper element, the porcelain enamel metal sheet that is used to protect the ribbon type bottom heating element is highly susceptible to cracks. Moreover, the porcelain enamel coated metal sheet illuminates infrared heating from the bottom element and is a poor heat conductor.

Both as a practical matter and to meet modern safety requirements, the bottom heating element in an electric oven must successfully resist liquid spills and impacts from pans, which has led to the use of the porcelain enamel coated sheet immediately above the bottom heating element which creates the inefficiencies and potential failures noted above. Heretofore a glass cover over the bottom electric heating element has been unacceptable because of the inability to meet the required impact resistance requirements and, to a lesser extent, the liquid spill resistance requirements.

SUMMARY OF THE INVENTION

The present invention is directed to an electric heating element system having an electric heating element positioned on a bottom wall with a compressible, nonbonding and heat resistant gasket positioned on the wall and a glass panel removably positioned over the electric heating element and on the gasket. A frame is arranged on an upper surface of the glass panel about its perimeter. The frame extends outwardly over an adjacent portion of the wall.

In a first separate aspect of the present invention, the frame has fasteners mounting the frame to the wall. The fasteners cause the frame and glass panel to partially compress the gasket for resilient support of the glass panel.

In a second separate aspect of the present invention, the frame has a sheet having inner and outer peripheral portions bent downwardly with fasteners mounting the frame to the wall between the inner and outer peripheral portions.

In a third separate aspect of the present invention, a bottom wall is included with a central recessed portion in the electric heating element system. The gasket is positioned on the wall about the periphery of the central recessed portion.

In a fourth separate aspect of the present invention, the foregoing separate aspects are contemplated to be in combination with an oven including an enclosure with top, sides, and rear walls, the bottom wall and a open front wall with a door.

In a fifth separate aspect of the present invention, any of the foregoing separate aspects are contemplated to be combination to further advantage.

Thus, it is a principle object of the present invention to provide a system for using a glass cover on a bottom electric heating element in a wall. The system is of particular applicability for an oven. Other objects and advantages will become apparent hereafter.

DETAILED DESCRIPTION OF THE PREFERRED EMBODIMENT

Figure 1:
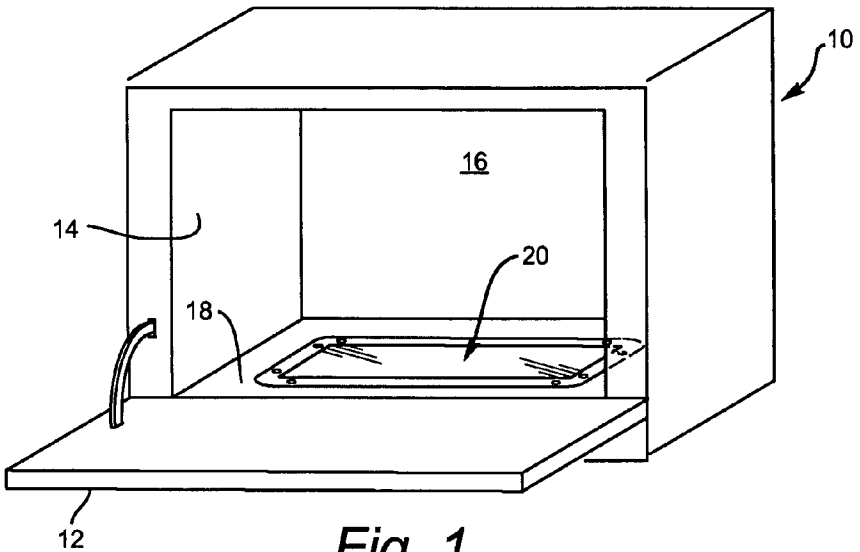
FIG. 1 is a perspective view of a typical oven having the bottom electric heating element system of the present invention.

Referring now to FIG. 1, a typical residential oven 10, such as the type that is wall mounted separate from a cooktop, is illustrated but it will be understood that the present invention is applicable to any form of residential cooking oven including ovens combined with a cooktop range, warming ovens or other cooking ovens. The oven 10 includes an open front wall closeable by a door 12 and walls forming a top or ceiling (unnumbered), sides 14, rear 16 and bottom 18. The top wall of the oven 10 may include a broiler-heating element that may be either gas or electric. The sidewalls 14 will include ledges (not shown) for supporting horizontal racks (not shown) that in turn support the cooking pans. The bottom wall 18 includes the bottom electric heating element system, generally designated 20, of the present invention.

Figure 4:
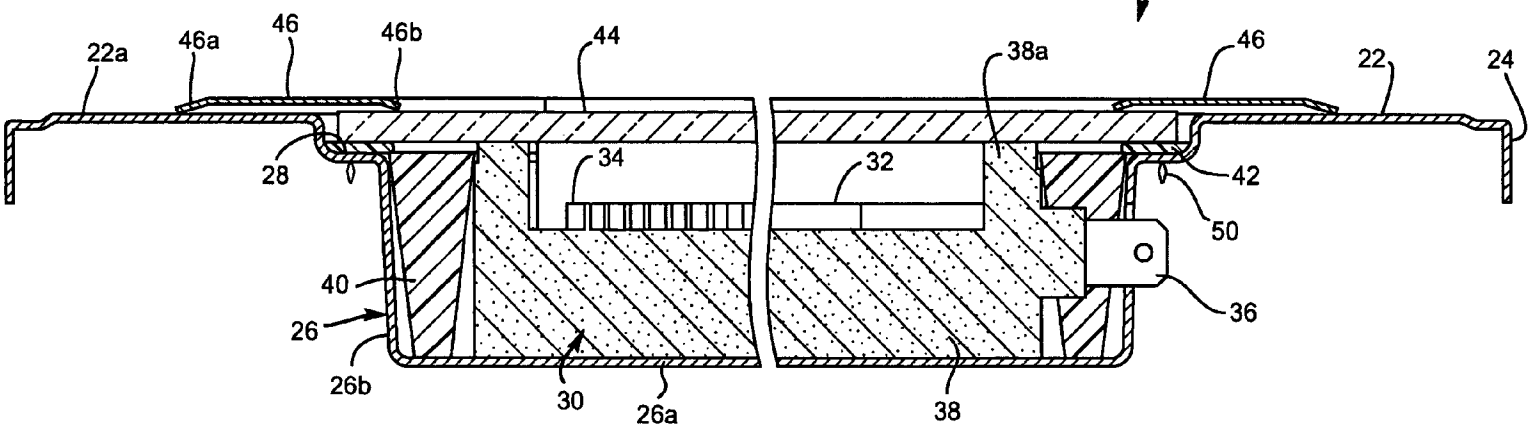
FIG. 4 is a sectional elevation view of the bottom electric heating element system of the present invention taken substantially on the line 4-4 in FIG. 2.
Figure 2:
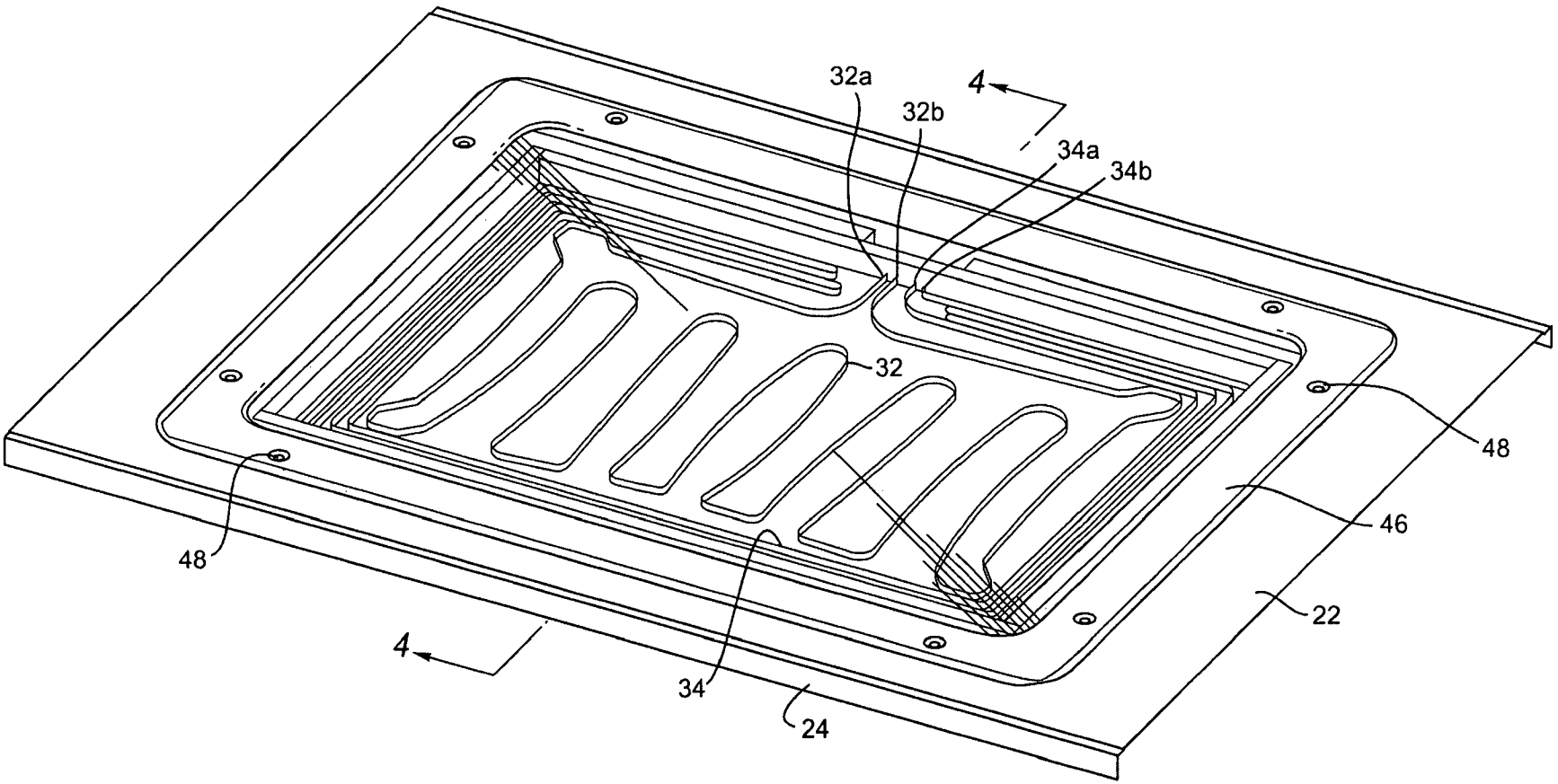
FIG. 2 is a perspective view of the bottom pan of the electric oven with the bottom electric heating element system of the present invention.
Figure 3:
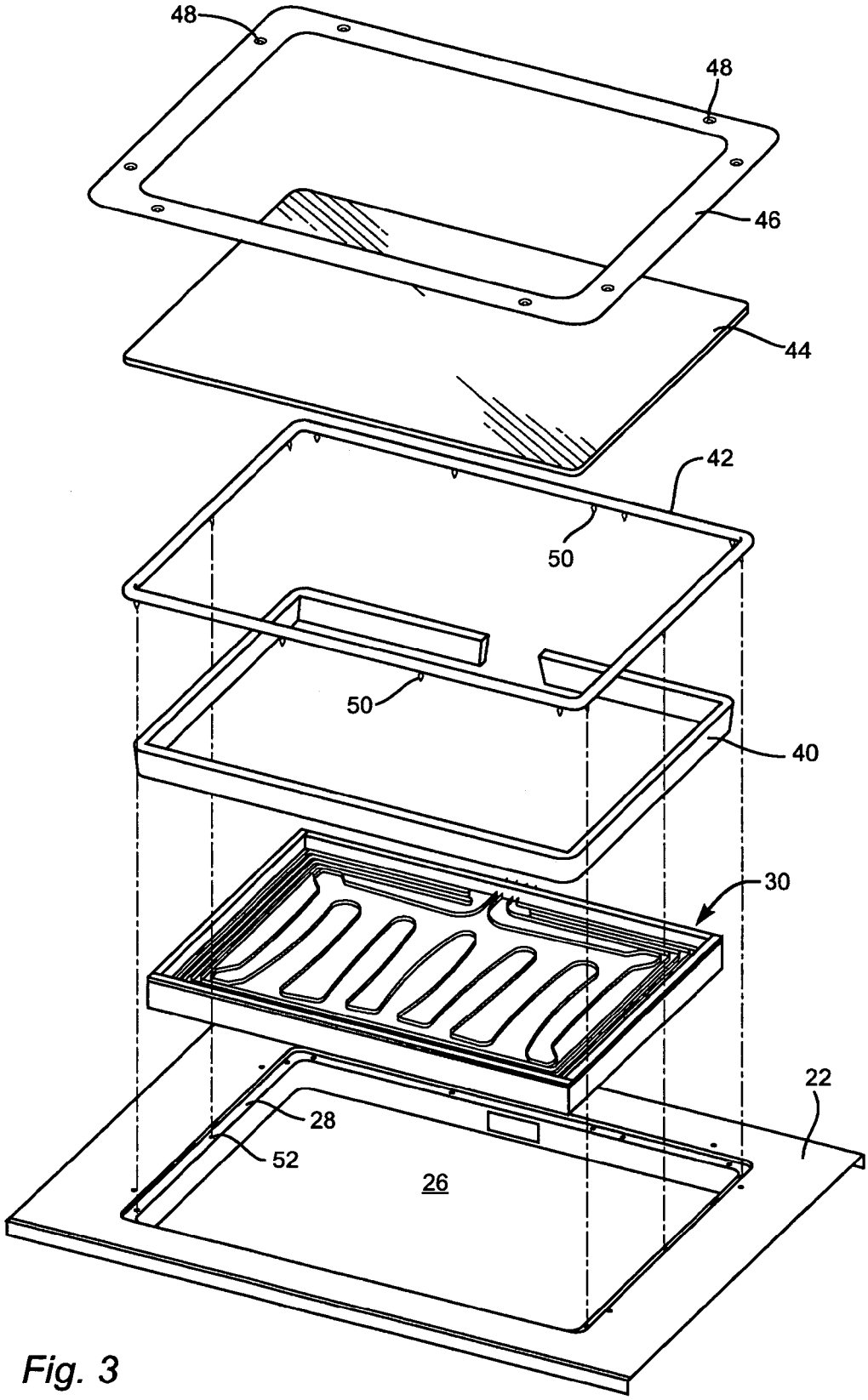
FIG. 3 is an exploded view of the bottom electric heating element system illustrated in FIG. 2.

Referring now to FIGS. 2-4, the bottom electric heating element system 20 is mounted in a bottom pan 22 that forms the bottom wall 18 of the oven 10. The bottom pan 22 and bottom electric heating element system 20 are shown separate from the remaining components of the oven 10 for the convenience of illustration. Further, the bottom pan 22 is shown with only a pair of flanges 24 along two edges for attaching to the other components of the oven 10 and it is to be understood that the other two edges of the bottom pan 22 also will be provided with flanges or other means for securing the bottom pan 22 in the oven 10 but the size, shape or extent of any such attachment means on the bottom pan 22 are not relevant to the present invention.

A major portion of the bottom pan 22 in the central area has a recessed portion 26 of a size and depth to accommodate the components of the bottom electric heating element system 20 of the present invention. An upwardly facing ledge 28 is provided around the perimeter of the upper end of the recessed portion 26 and spaced downwardly below the upper surface 22*a* of the bottom pan 22.

An electric heating element assembly, generally designated 30, is provided in the recessed portion 26 of the bottom pan 22. The electric heating element assembly 30 preferably includes two separate heating elements 32 and 34 that preferably are formed of a corrugated metallic ribbon, although other forms of heating elements may be used. Also, a single or more than two heating elements may be used, as will readily appear to those skilled in the art.

The first heating element 32 comprises a single length of metallic ribbon that is formed in a serpentine arrangement to cover most of the upper surface of the electric heating element assembly. The two ends 32*a* and 32*b* of the ribbon-like element 32 extending into the rear wall of the assembly 30 where each is separately joined to an electrical connector, such as connector 36 shown in FIG. 4.

The second electric heating element 34 is also comprised of a corrugated ribbon-like element and preferably is formed into multiple loops extending around the internal periphery of the electric heating element assembly 30 with two such loops shown in the preferred embodiment in FIG. 2. The two ends 34*a* and 34*b* of the ribbon-like element 34 also extend into the rear wall of the electric heating element assembly 30 and are joined to separate electrical connectors 36.

The ribbon-like electric heating elements 32 and 34 are embedded in a ceramic insulating material 38 which is formed to provide a peripheral wall portion 38*a* of a sufficient height to protect the heating elements 32 and 34. The insulating material 38 is of a sufficient thickness vertically that the bottom wall 26*a* of the recessed portion 26 of the bottom pan 22 does not become over heated. The inventors have found that an electric heating element assembly 30 sold under the trademark "CERAMASPEED" by Ceramaspeed Ltd. of Kidderminster, England is well suited for use in the bottom electric heating element system 20 of the present invention, although any similar assembly 30 by any other manufacturer that has similar characteristics would be acceptable.

In the preferred assembly 30, the electric heating elements 32 and 34 have a 3100 watt rating with element 32 having a 1600 watt rating and element 34 having a 1500 watt rating, which provides excellent and rapid heating for the oven 10, although it is to be understood that any wattage ratings may be used. By separately operating electric heating element 32 without operating electric heating element 34, a lower heating rate and maximum temperature may be provided. If even greater control over the heating rate and maximum temperature were desirable, three or more separate heating elements may be provided in the assembly 30.

A separate insulating wall 40 is provided and encircles the electric heating element assembly 30 to minimize the heat transfer from the assembly 30 to the vertical wall 26*b* of the recessed portion 26 of the bottom pan 22. A gasket 42 is provided on the ledge 28 surrounding the recessed portion 26 of the bottom pan 22. A glass panel 44 is supported on the gasket 42 and ledge 28.

The glass panel 44 is held in place by a metal frame 46 surrounding the upper peripheral surface of the glass panel 44 and overlapping a portion of the upper surface 22*a* of the bottom pan 22. The frame 46 has outer and inner peripheral edge portions 46*a* and 46*b*, respectively, that are bent downwardly a small amount from the main portion of the frame 46 extending between those edge portions. The frame 46 is provided with a plurality of holes 48, eight of which are shown in FIGS. 2 and 3, through which fastening screws (not shown) are provided for securing the frame to the bottom pan 22. The holes 48 are between the downwardly bent edge portions 46*a* and 46*b* of the frame 46 so that the tightening of the screws flexes the frame 46 to resiliently apply a downward mounting force to the glass panel 44. In turn, the glass panel 44 resiliently compresses the gasket 42, whereby the glass panel 44 is resiliently supported in this bottom electric heating element system 20. The glass panel 44 also engages the upper end of peripheral wall portion 38*a*.

The resilient support arrangement for the glass panel 44 allows for the different rates of thermal expansion of the various components and assists in absorbing impacts to the glass panel 44 without breakage. In the assembled condition, the upper surface of glass panel 44 is approximately level with the upper surface 22*a* of the bottom pan 22.

While various forms and compositions of the gasket 42 may be acceptable for use in the bottom electric heating element system 20 of the present invention, a so-called "Clip Gasket" oven seal made by Davlyn Manufacturing Co., Inc. is preferred. This Clip Gasket oven seal is conventionally used around the periphery of the front opening of an oven and has been found to successfully resist the high oven temperatures and provide excellent sealing. The Clip Gasket is comprised of a braided ECG fiberglass tube surrounding a knitted stainless steel wire tube or spring that retains its resiliency even in the high temperatures associated with a cooking oven. Thus, the glass panel 44 is effectively supported by a resilient, tubular spring in the gasket 42. The gasket 42 is held in place on ledge 28 by a plurality of stainless steel wire clips 50 that are spaced along and protrude from the gasket 42 for inserting through holes 52 provided in the ledge 28 of the bottom pan 22.

The glass panel 44 is comprised of a high temperature and impact resistant glass that preferably is transparent or at least semi-transparent for allowing the transmission of infrared light for heating the oven. One such glass panel 44 that has been found acceptable is sold under the trademark CERAN-HIGHTRANS by Schott Corporation, Technical Glass Division, Appliance Products Group, Yonkers, N.Y. and it is either a black or orange-brown color, resists thermal stress with a temperature differential of about 1200° F., and resists thermal stress fracture by shock up to about 1200° F., such as by dousing with cold water. The black CERAN-HIGHTRANS glass has a pleasing black appearance but when the electric heating elements 32 and 34 are activated they are readily visible as glowing ribbons that provide an immediate visual indication that the oven is in a heating mode. Another high temperature and impact resistant glass that is also suitable for glass panel 44 is sold under the trademark ROBAX by the Schott Corporation, which is a clear and transparent glass.

The above-described bottom electric heating element system 20 of the present invention overcomes the disadvantages of prior art bottom electric heating elements in that the conventional porcelain enamel coated steel cover over the heating element is eliminated to thereby allow more efficient heat transfer from the heating elements to the oven cavity as well as providing infrared heating. The glass panel 44 is not susceptible to deterioration and cracking as is the porcelain enamel coating on a steel panel and may be easily cleaned.

The resilient supporting arrangement for the glass panel 44 as provided by the resilient gasket 42 and the resilient mounting frame 46 enhances the impact resistance of the glass panel 44 and avoids any problems of differential rates of thermal expansion of the components. While the frame 46 with its outer edge 46*a* engaging the upper surface 22*a* of the bottom pan 22 and its inner edge 46*b* engaging the glass panel 40 resists the intrusion of any liquid spills into the recessed portion 26 of the bottom pan 22, any such spillage that bypasses the frame 46 will be absorbed by the gasket 42 or excessive leakage will merely drain to the bottom of the recessed portion 26. In the unlikely event that there is a malfunction in the electric heating element assembly 30 or the glass panel 44 breaks, maintenance may be readily performed by merely removing the frame 46 from the bottom pan 22 by removing the mounting screws (not shown) and then lifting the various components out of the recessed portion 26 of the bottom pan 22. In the heretofore conventional bottom electric heating element systems any such malfunctioned usually required replacement of the entire oven cavity walls.

Although a specific, preferred embodiment of the present invention is described above, it is to be understood that various modifications of that preferred embodiment will readily appear to those skilled in the art and yet fall within the scope of the present invention as defined by the following claims.

What is claimed is:

1. An electric heating element system comprising:

a bottom wall including a central recessed portion;

an electric heating element positioned on the wall in the central recessed portion;

a compressible, nonbonding and heat resistant gasket positioned on the wall about the periphery of the central recessed portion;

a glass panel removably positioned over the electric heating element and on the gasket:

a flexible frame being a sheet having inner and outer peripheral portions bent downwardly mounted to the wall and held on an upper surface of the glass panel about the perimeter thereof and extending outwardly over an adjacent portion of the wall; and fasteners mounting the flexible frame to the wall between the inner and outer peripheral portions and the fasteners causing the flexible frame and glass panel to partially compress the gasket to resiliently support the glass panel;

an enclosure including top, sides, rear walls, the bottom wall and an open front wall with a door.

2. The electric heating element system of claim 1, the wall including a peripheral recessed portion about the central recessed portion which is recessed less than the central recessed portion, the peripheral recessed portion receiving the perimeter of the glass panel and the gasket.

3. The electric heating element system of claim 1, the gasket comprising a braided fiberglass sleeve encircling a knitted wire spring.

4. An oven comprising:

an enclosure including top, sides, rear and bottom walls and a open front wall with a door, the oven bottom wall including a central recessed portion, and a peripheral recessed portion about the central recessed portion which is recessed less than the central recessed portion;

a bottom electric heating element system including an electric heating element positioned on the bottom wall, a compressible, nonbonding and heat resistant gasket of braided fiberglass sleeve encircling a knitted wire spring positioned on the bottom wall, a glass panel removably positioned over the electric heating element and on the gasket, a flexible frame being a sheet having inner and outer peripheral portions bent downwardly mounted to the wall and held on an upper surface of the glass panel about the perimeter thereof and extendinq outwardly over an adjacent portion of the wall whith the glass panel partially compressing the gasket to resiliently support the glass panel, the electric heating element being in the recessed portion, the peripheral recessed portion receiving the perimeter of the glass panel, the frame being a sheet having inner and outer peripheral portions bent downwardly.

* * * * *